US011364736B2

(12) United States Patent
Bez et al.

(10) Patent No.: US 11,364,736 B2
(45) Date of Patent: Jun. 21, 2022

(54) WRITING FELT PEN

(71) Applicant: Société BIC, Clichy (FR)

(72) Inventors: Arnaud Bez, Clichy (FR); Franck Rolion, Clichy (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/906,376

(22) Filed: Jun. 19, 2020

(65) Prior Publication Data

US 2020/0398605 A1 Dec. 24, 2020

(30) Foreign Application Priority Data

Jun. 20, 2019 (EP) ..... 19305793

(51) Int. Cl.
*B43K 8/03* (2006.01)
*B43K 8/00* (2006.01)
*B43K 8/06* (2006.01)

(52) U.S. Cl.
CPC ..... *B43K 8/03* (2013.01); *B43K 8/003* (2013.01); *B43K 8/06* (2013.01)

(58) Field of Classification Search
CPC . B43K 1/006; B43K 1/12; B43K 8/02; B43K 8/022; B43K 8/024; B43K 8/026; B43K 8/028; B43K 8/03
See application file for complete search history.

(56) References Cited

U.S. PATENT DOCUMENTS 1,895,850 A 1/1933 Holtzman
4,970,854 A * 11/1990 Komiya ..... B43K 1/12 401/199
4,976,564 A * 12/1990 Fukuoka ..... A45D 34/042 401/176
5,297,883 A * 3/1994 Ozu ..... B43K 7/00 401/199
5,443,322 A 8/1995 Jozat et al.
5,620,641 A 4/1997 Berger
6,893,181 B1 * 5/2005 Duez ..... B43K 1/12 156/180
7,044,675 B2 * 5/2006 Nowak ..... B43K 5/18 401/225
7,530,753 B2 * 5/2009 Kobayashi ..... B43K 7/005 401/194
8,541,643 B2 * 9/2013 Ring ..... D06M 15/263 604/368
10,730,338 B2 * 8/2020 Murphy ..... B43L 19/0068
2013/0004231 A1 * 1/2013 Nakatani ..... B43K 8/02 401/198

FOREIGN PATENT DOCUMENTS

| | | |
|---|---|---|
| DE | 4313180 | 10/1994 |
| EP | 3053970 | 8/2016 |
| JP | 2009274404 | 11/2009 |
| WO | 2017122457 | 7/2017 |

OTHER PUBLICATIONS

Extended European Search Report dated Dec. 13, 2019 from priority application No. 19305793.2 , 5 pages.

* cited by examiner

*Primary Examiner* — David P Angwin
*Assistant Examiner* — Bradley S Oliver
(74) *Attorney, Agent, or Firm* — Ohlandt, Greeley, Ruggiero and Perle, LLP

(57) ABSTRACT

A writing felt pen including a barrel and a nib attached to the barrel, and a deformable pouch comprising a mix of absorbent polymer and fibres, an ink being absorbed in the absorbent polymer and the nib being in fluidic communication with the mix.

18 Claims, 3 Drawing Sheets

WRITING FELT PEN

CROSS REFERENCE TO RELATED APPLICATION(S)

This application claims priority to European Application No. EP 19 305 793.2, filed on Jun. 20, 2019, the entire contents of which is incorporated herein by reference.

TECHNICAL FIELD

The present disclosure is related to a hand writing device, and more particularly to writing felt pen.

BACKGROUND

Writing felt pen generally have a barrel comprising an ink system component having a cylindrical shape. So as to avoid dead space in the barrel and/or important material thickness for the barrel, the shape of the barrel is therefore also cylindrical.

SUMMARY

Therefore, according to embodiments of the present disclosure, a writing felt pen is provided. The writing felt pen includes a barrel, a nib attached to the barrel, and a deformable pouch comprising a mix of absorbent polymer and fibres, an ink being absorbed in the absorbent polymer and the nib being in fluidic communication with the mix.

The nib may be inserted into a buffer, the buffer being in contact with the mix.

The buffer may have a porosity greater than the porosity of the nib.

The buffer may be a porous system with interconnected open pore.

The buffer may be a fibrous system included in a sheath or a plastic baffle.

The buffer may be made of long fibres mixed together and locally glued using a resin.

The resin may be an urethane resin or an aminoplast resin.

The buffer may be made of bi-components long fibres having an inner core of high molecular weight material and an outer shell of low molecular weight material, the low molecular weight material having a lower glass transition temperature than the high molecular weight material, the outer shell being fused to create surface attachment points after cooling.

The fibres may be made of polyethylene, polyester, polyamide or polyacrylonitrile.

The fibres may be fibres having a denier between 1 and 10 den (denier).

The fibres may be continuous fibres having a length greater than 10 cm (centimetre).

The continuous fibres may have a length equal to or smaller than five times the maximum barrel length.

The fibres may be staple fibres having a length equal to or smaller than 10 cm.

The content of absorbent polymer in the mix may be capable of absorbing all the ink.

The absorbent polymer may be made of polyacrylamide of potassium, polyacrylamide of sodium, polyacrylate of potassium, polyacrylate of sodium or crosslinked poly(itaconate).

The nib may be a sintered powder nib comprising polypropylene or polyethylene.

The nib may include fibres agglomerated by a resin, the fibres being polyester, acrylic, polyamide or polyacrylonitrile and the resin being polyurethane or urea aminoplast.

The nib may be an extruded nib comprising polyacetal, polypropylene or polyethylene.

The deformable pouch may be distinct from the barrel.

The ratio in mass of the mass of ink and the mass of the absorbent polymer without absorbed ink may be equal to or smaller than 1000, preferably equal to or smaller than 750, more preferably equal to or smaller than 550.

The mass of fibres per ink volume may be equal to or greater than 0.001 g of fibres per $cm^3$ of ink, preferably equal to or greater than 0.01 g of fibres per $cm^3$ of ink, more preferably equal to or greater than 0.1 g of fibres per $cm^3$ of ink and equal to or smaller than 1 g of fibres per $cm^3$ of ink, preferably equal to or smaller than 0.8 g of fibres per $cm^3$ of ink, more preferably equal to or smaller than 0.6 g of fibres per $cm^3$ of ink.

By providing such a configuration, in particular, a mix of absorbent polymer and fibres with an ink being absorbed in the absorbent polymer, it is possible to have barrel having a free form and to avoid dead space in the barrel and/or important material thickness for the barrel. Indeed, the shape of the barrel is no longer dictated by the cylindrical shape of ink system component.

The absorbent polymer may generally absorb water up to five hundred times the mass of the absorbent polymer. As the ink may have a density different from the density of water, for example greater than 0.78 and equal to or smaller than 1.3, the mass of ink that may be absorbed by the absorbent polymer may vary in accordance.

Thanks to the mix including an absorbent polymer and fibres, the ink absorbed in the absorbent polymer is drained by the fibres from the absorbent polymer to the nib, which is in fluidic communication with the mix, so as to have a continuous ink flow in the nib.

Thanks to the deformable pouch including the mix, when the ink is consumed, the volume and the shape of the deformable pouch may adapt to the volume of the mix still present in the deformable pouch and the the nib may be kept in fluidic communication with the mix.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DETAILED DESCRIPTION

Reference will now be made in detail to exemplary embodiments of the disclosure, examples of which are illustrated in the accompanying drawings. Wherever possible, the same reference numbers will be used throughout the drawings to refer to the same or like parts.

Figure 1:
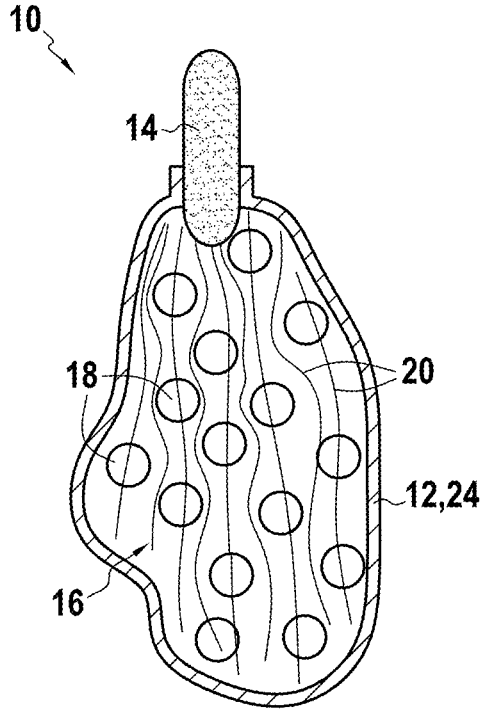
FIG. 1 shows a representation of an exemplary writing felt pen according to embodiments of the present disclosure.

FIG. 1 shows a representation of an exemplary writing felt pen 10 according to embodiments of the present disclosure. The writing felt pen 10 may include a barrel 12 and a nib 14. The nib 14 may be fixed on the barrel 12. The writing felt pen 10 shown at FIG. 1 includes a deformable pouch 24. In the writing felt pen 10 shown at FIG. 1, the barrel 12 and the deformable pouch 24 are the same element. The deformable pouch 24 may include a mix 16 of absorbent polymer 18 and fibres 20. An ink is absorbed in the absorbent polymer 18.

Figure 6:
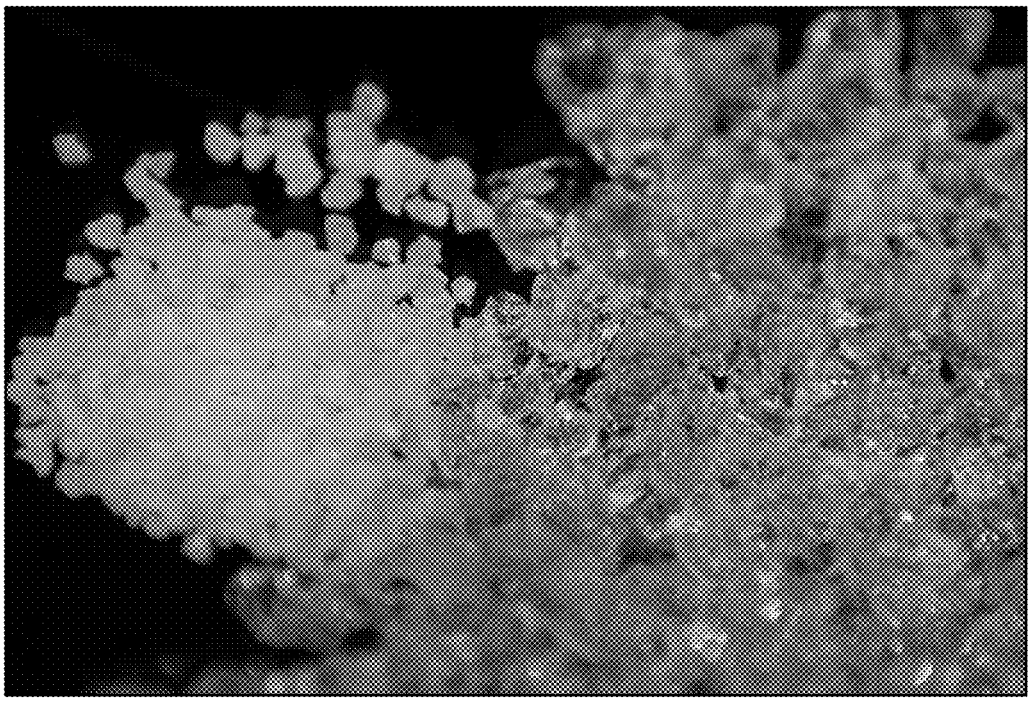
FIG. 6 shows an absorbent polymer without absorbed water and with absorbed water.

The absorbent polymer 18 is schematically represented as balls but it is understood that the shape of the absorbent polymer 18 is not limited to balls. Indeed, in general, the absorbent polymer 18 may have non regular shape both when no ink is absorbed and when ink is absorbed in the absorbent polymer 18, as shown at FIG. 6 without and with water absorbed.

As shown at FIG. 1, the shape of the barrel 12 is not limited to cylindrical shape and the fibres 20 may be continuous fibres.

As shown at FIG. 1, the nib 14 is in fluidic communication with the mix 16 and the ink absorbed in the absorbent polymer 18 may flow continuously from the absorbent polymer 18 to the nib 14.

Figure 2:
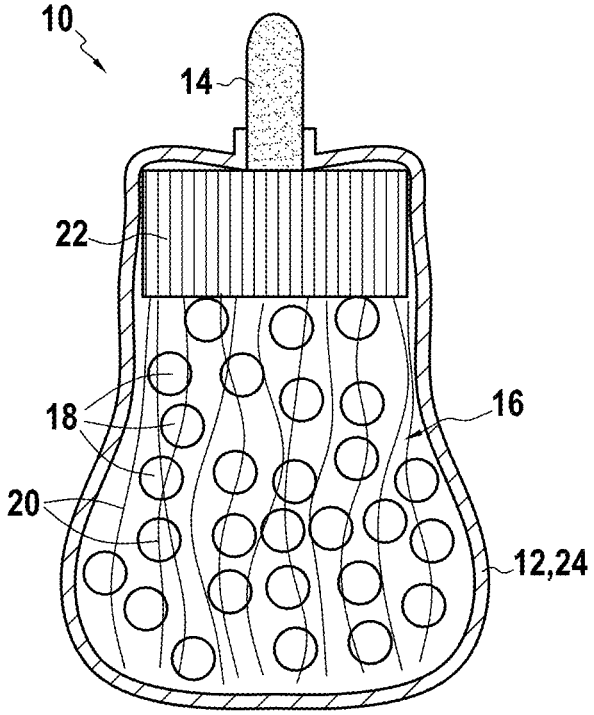
FIG. 2 shows another representation of an exemplary writing felt pen according to embodiments of the present disclosure.

Another representation of an exemplary writing felt pen 10 according to embodiments of the present disclosure is shown at FIG. 2. The exemplary writing felt pen 10 shown at FIG. 2 is similar to the exemplary writing felt pen 10 shown at FIG. 1 and differs from to the exemplary writing felt pen 10 shown at FIG. 1 in that the writing felt pen 10 may include a buffer 22, in which the nib 14 may be inserted, the buffer 22 being in contact with the mix 16.

Figure 3:
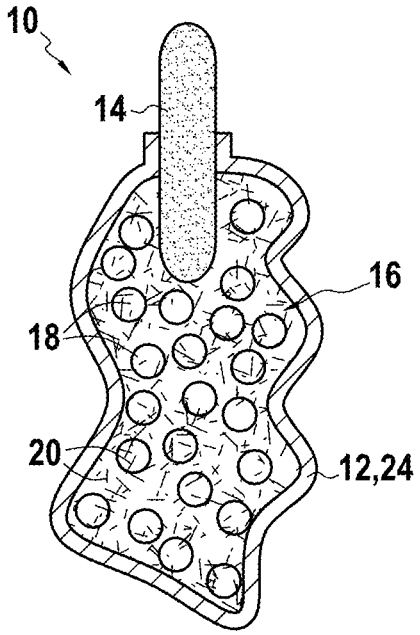
FIG. 3 shows another representation of an exemplary writing felt pen according to embodiments of the present disclosure.

Another representation of an exemplary writing felt pen 10 according to embodiments of the present disclosure is shown at FIG. 3. The exemplary writing felt pen 10 shown at FIG. 3 is similar to the exemplary writing felt pen 10 shown at FIG. 1 and differs from to the exemplary writing felt pen 10 shown at FIG. 1 in that the fibres 20 may be staple fibres.

Figure 4:
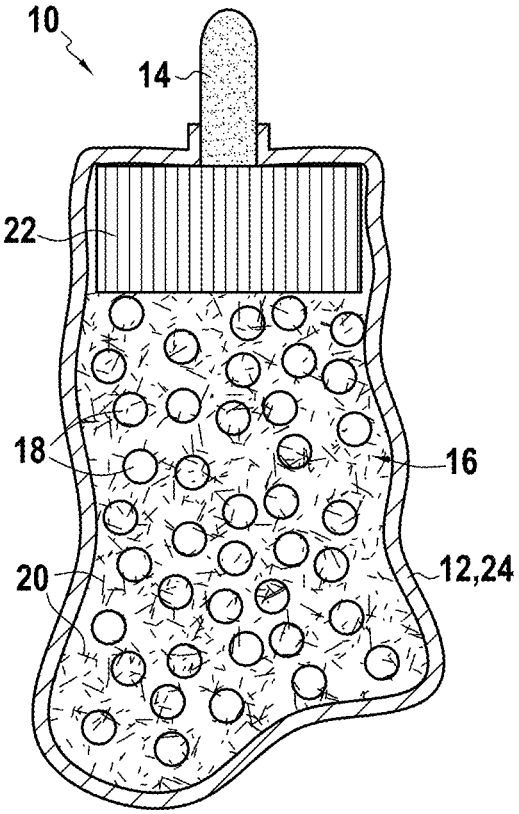
FIG. 4 shows a another representation of an exemplary writing felt pen according to embodiments of the present disclosure.

Another representation of an exemplary writing felt pen 10 according to embodiments of the present disclosure is shown at FIG. 4. The exemplary writing felt pen 10 shown at FIG. 4 is similar to the exemplary writing felt pen 10 shown at FIG. 2 and differs from to the exemplary writing felt pen 10 shown at FIG. 2 in that the fibres 20 may be staple fibres.

Figure 5:
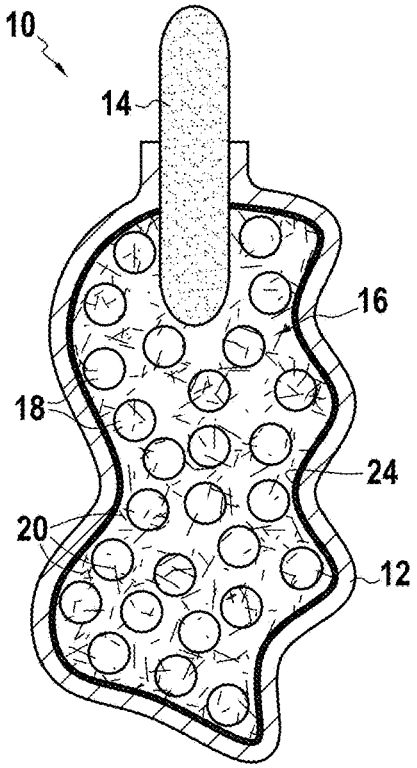
FIG. 5 shows another exemplary spoked wheel according to embodiments of the present disclosure.

Another representation of an exemplary writing felt pen 10 according 10 to embodiments of the present disclosure is shown at FIG. 5. The exemplary writing felt pen 10 shown at FIG. 5 is similar to the exemplary writing felt pen 10 shown at FIG. 3 and differs from to the exemplary writing felt pen 10 shown at FIG. 3 in that the barrel 12 and the deformable pouch 24 may be distinct from one another.

In the writing felt pen 10 shown at FIG. 5, it is understood that the barrel 12 may not be deformable, i.e., the barrel may be rigid and/or less deformable than the deformable pouch 24.

It is understood that the deformable pouch 24 may be included in any of the previous exemplary writing felt pen 10.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A writing felt pen comprising a barrel, a nib attached to the barrel, and a deformable pouch comprising a mix of absorbent polymer and fibres, wherein the absorbent polymer has a ink absorbed therein and the nib is in fluidic communication with the mix, and wherein the mix is capable of absorbing all the ink.

2. The writing felt pen according to claim 1, wherein the nib is inserted into a buffer, the buffer being in contact with the mix.

3. The writing felt pen according to claim 2, wherein the buffer has a porosity greater than the porosity of the nib.

4. The writing felt pen according to claim 1, wherein the fibres are made of a material selected from the group consisting of polyethylene, polyester, polyamide, and polyacrylonitrile.

5. The writing felt pen according to claim 1, wherein the fibres are fibres having a denier between 1 and 10 den.

6. The writing felt pen according to claim 1, wherein the fibres are continuous fibres having a length greater than 10 cm.

7. The writing felt pen according to claim 6, wherein the continuous fibres have a length equal to or smaller than five times the maximum barrel length.

8. The writing felt pen according to claim 1, wherein the fibres are staple fibres having a length equal to or smaller than 10 cm.

9. The writing felt pen according to claim 1, wherein the absorbent polymer is made of a material selected from the group consisting of polyacrylamide of potassium, polyacrylamide of sodium, polyacrylate of potassium, polyacrylate of sodium, and crosslinked poly(itaconate).

10. The writing felt pen according to claim 1, wherein the nib is a sintered powder nib.

11. The writing felt pen according to claim 10, wherein the sintered powder nib comprises polypropylene or polyethylene.

12. The writing felt pen according to claim 1, wherein the nib comprises fibres agglomerated by a resin, the fibres being selected from the group consisting of polyester, acrylic, polyamide, and polyacrylonitrile, and the resin being polyurethane or urea aminoplast.

13. The writing felt pen according to claim 1, wherein the nib is an extruded nib comprising polyacetal, polypropylene or polyethylene.

14. The writing felt pen according to claim 1, wherein the deformable pouch is distinct from the barrel.

15. The writing felt pen according to claim 1, wherein the ratio in mass of the mass of ink and the mass of the absorbent polymer without absorbed ink is equal to or smaller than 1000.

16. The writing felt pen according to claim 1, wherein the mix has a mass of fibres per ink volume that is equal to or greater than 0.001 g of fibres per $cm^3$ of ink and equal to or smaller than 1 g of fibres per $cm^3$ of ink.

17. The writing felt pen according to claim 1, wherein the mix has a mass of fibres per ink volume that is equal to or greater than 0.01 g of fibres per $cm^3$ of ink and equal to or smaller than 0.8 g of fibres per $cm^3$ of ink.

18. The writing felt pen according to claim 1, wherein the mix has a mass of fibres per ink volume that is equal to or greater than 0.1 g of fibres per $cm^3$ of ink and equal to or smaller than 0.6 g of fibres per $cm^3$ of ink.

* * * * *